US006523315B2

(12) United States Patent
Ford

(10) Patent No.: US 6,523,315 B2
(45) Date of Patent: Feb. 25, 2003

(54) ATTACHMENTS AND DEVICES FOR STRAIGHTENING, SQUARING AND ALIGNING SUPPORT MEMBERS TO RECEIVE EXTERIOR FINISHING MEMBERS AND METHODS THEREFOR

(76) Inventor: Dan E. Ford, 78 Valley Stream Rd., Rhinebeck, NY (US) 12572

( * ) Notice: Subject to any disclaimer, the term of this patent is extended or adjusted under 35 U.S.C. 154(b) by 0 days.

(21) Appl. No.: 09/810,118

(22) Filed: Mar. 16, 2001

(65) Prior Publication Data

US 2002/0005023 A1 Jan. 17, 2002

Related U.S. Application Data

(63) Continuation-in-part of application No. 09/723,422, filed on Nov. 28, 2000, now abandoned.
(60) Provisional application No. 60/218,698, filed on Jul. 17, 2000.

(51) Int. Cl.[7] ..... E02D 37/00
(52) U.S. Cl. ..... 52/514; 52/85; 52/86; 52/730.7; 52/731.1; 52/731.5; 52/737.3; 52/737.5
(58) Field of Search ..... 52/514, 730.7, 52/731.1, 731.5, 731.9, 85, 86, 737.3, 737.5

(56) References Cited

U.S. PATENT DOCUMENTS

| | | | | |
|---|---|---|---|---|
| 1,833,174 A | * | 11/1931 | Norris | 52/716 |
| 2,190,004 A | * | 2/1940 | Baker | 52/716 |
| 3,094,197 A | * | 6/1963 | Attwood | 52/639 |
| 3,208,119 A | * | 9/1965 | Seckerson | 52/514 |
| 3,477,187 A | | 11/1969 | Fruman | |
| 4,227,360 A | | 10/1980 | Balinski | |
| 4,242,848 A | * | 1/1981 | Schoultz | 52/716 |
| 4,466,225 A | | 8/1984 | Hovind | |
| 5,440,848 A | | 8/1995 | Deffet | |
| 5,450,697 A | | 9/1995 | Prucinsky et al. | |
| 5,572,834 A | | 11/1996 | Lilly | |
| 5,662,310 A | | 9/1997 | Carson, Sr. | |
| 5,671,583 A | | 9/1997 | Turner | |
| 5,822,942 A | | 10/1998 | Lucia, Jr. | |
| 5,896,716 A | * | 4/1999 | Jalla | 52/514 |
| 6,148,579 A | * | 11/2000 | Rolf | 52/639 |

OTHER PUBLICATIONS

'Straightening Framed Walls' by Henry Derek McDonald Aug./Sep. 2000 Issue of Fine Home Building.

* cited by examiner

*Primary Examiner*—Lanna Mai
*Assistant Examiner*—Dennis L. Dorsey
(74) *Attorney, Agent, or Firm*—Lerner, David, Littenberg, Krumholz & Mentlik, LLP

(57) ABSTRACT

Sized and shaped attachments made of suitable materials and having a predetermined thickness for straightening and replacing studs, joists and rafters, squaring of openings and for aligning a plurality of the studs, joists and rafters in the framing for a building to provide a planar application surface to which exterior finishing members can be affixed. The attachments have sized and spaced openings thereon operatively associated by frictional engagement with fastening members each having a slidable member thereon to enable the attachments or devices to be adjustably fastened to a given stud, joist or rafter so a plurality of such adjusted attachments or any replacement attachments can be aligned with each other to provide the planar application surface. Methods are provided to align a multiplicity of adjoining studs, joists or rafters, to square and to square and align openings with such attachments to provide the planar application surfaces.

11 Claims, 6 Drawing Sheets

ATTACHMENTS AND DEVICES FOR STRAIGHTENING, SQUARING AND ALIGNING SUPPORT MEMBERS TO RECEIVE EXTERIOR FINISHING MEMBERS AND METHODS THEREFOR

CROSS-REFERENCE TO RELATED APPLICATIONS

This application is a continuation-in-part of Applicant's co-pending application filed Nov. 28, 2000, ABN under application Ser. No. 09/723,422 and claims the benefits of said co-pending application and of a Provisional Application filed, pro se, by the Applicant and Inventor, Dan Ford, in the U.S. Patent and Trademark Office on Jul. 17, 2000 under application Ser. No. 60/218,698 entitled STRAIGHT SPACE STUDS, the disclosure of which is incorporated herein by reference.

BACKGROUND OF THE INVENTION

The present invention relates generally to the framing and covering of walls, ceilings and floors in new construction and in the remodeling of buildings and, more particularly, to relatively simple shaped attachments and devices to straighten and square support members such as studs, joists and rafters forming walls, floors, ceilings or window and door openings in the framing for such new construction or in buildings being remodeled and the method for using such attachments and devices so that at least one face of a plurality of such support members can be aligned with each other to establish and provide a common, straight and level application plane for affixing any desired exterior finishing members such as paneling, wallboard, sheetrock, floor and ceiling tile, flooring and the like thereto.

During the construction of buildings or in the remodeling of buildings, more particularly in residential buildings, those skilled in the art know that during the framing of buildings, the studs and joists are usually spaced about 16" on centers, and double studs or joists are set up around window, door and other openings to provide strength and support for the building and for providing the desired plane for affixing an exterior finishing surface thereon. The construction industry has found that the support members, generally wooden studs, joists and rafters which form the application surfaces to which exterior finishing members are attached, while still structurally sound, tend to become warped, bowed and twisted so that a plurality of such studs, joists and rafters cannot provide the common, flat and level application plane preferred for affixing such exterior finishing members.

Various methods have been developed to meet and overcome this problem. For example, measurements are taken and string lines placed transversely across a plurality of such support members to determine the misalignment that exists for the formation of an application surface by such plurality of studs or joists so that misaligned studs or joists can be removed and replaced with new wooden studs, joists or rafters, as the case may be, for a wall, floor or ceiling. Generally, this process is expensive because it requires the services of two fairly skilled carpenters until a straight and level application surface is established.

In the above example, those skilled in the art will recognize that wooden studs or joists are heavy and bulky, must be purchased, loaded into and transported in a suitable vehicle, unloaded at the side of the building, and held into position while being fastened to the upper header and lower plates associated with the other studs, joists or rafters. If the studs, joists or rafters are not properly aligned, which is often difficult to determine until the studs or joists are in position, then the nails fastening the incorrectly aligned new studs, joists or rafters must be removed and the stud realigned and refastened once again, all at additional cost and expense to the construction company.

Another factor which compounds replacement of such support members is the force of gravity which is always acting on the overall integrity of the building and, more particularly, on those support members such as the wooden stud or joist being replaced while there is nothing to hold it while replacement is in progress, other than an additional carpenter or carpenter's helper.

Another method for overcoming this problem is described in an article entitled Straightening Framed Walls by Henry Derek McDonald, which appeared in the August/September 2000 issue of Fine Home Building. In this article the wooden studs and joists are planed or furred or replaced or, if not replaceable, are "strong-backed" to establish the straight and level application surface for the exterior finishing members.

Other methods for achieving this end are shown in U.S. Pat. Nos. 3,477,187; 4,227,360; 5,662,310 and 5,822,942. Additionally, devices for replacing or for modifying studs are also shown in U.S. Pat. Nos. 4,466,225 and 5,440,848.

U.S. Pat. No. 5,822,942 to Lucia Jr. shows a U-shaped device for straightening warp, twisted, improperly installed or inaccurately aligned studs, joists and rafters and an involved method for forming a common planar mounting surface for exterior finishing members which utilizes a plurality of these U-shaped devices applied to a corresponding plurality of studs, joists or rafters.

In the straightening function of the U-shaped device, for a given stud, joist or rafter, the common reference point for attaching the exterior finishing material is for example the forward corner 56 of the front angled face of the given warped stud 16' shown in FIG. 3 of the drawings in Patent '942. The U-shaped device is adjustably positioned on the stud 16' using this reference point and then fastened to the stud in its adjusted position. However, this does and will not give the desired planar mounting surface in a common plane with a multiplicity of other studs, required for properly affixing the exterior finishing members to the plurality of studs, joists or rafters defining a wall, floor or ceiling in a building.

Where a plurality of studs, joists or rafters need to be aligned to achieve the required planar mounting surface for the exterior finishing members, Pat. '942 provides an additional bar 60 which is first threadably affixed to the outer sections 34 for each of the respective U-shaped devices for an associated plurality of studs, joists or rafters which in the aligned or plumbed position are then affixed to their associated studs, joists or rafters to establish the planar mounting surface in a common plane required to properly affix the exterior finishing members over a plurality of studs, joists or rafters. This method of achieving the planar mounting surface with a common plane creates the very same problems of the prior art as above described by increasing the steps for establishing the planar mounting surface, the number of people required, the time and the need for calculations to achieve the common plane for the planar mounting surface. More important this method and the device used do not address the problem of a wall with a multiplicity of studs where some studs are misaligned because they are warped from side to side or twisted or bowed into or away from the room or space.

The prior art methods are often beneficial to old ceilings or floors because the addition of new wooden joists or metal replacement elements lends strength to the existing structure. It has been found, however, in the construction industry that even with new wooden studs and joists or replacement elements therefor, it is very difficult, without almost totally demolishing the old existing structure, to obtain the desired straight and level application plane on which to install and affix the exterior finishing members for a given room or space in the building.

Thus, using these known prior art processes, it has been found that a normal 12'×17' bedroom requires the labor of two men for two work days, and the equipment of a truck/trailer for hauling the replacement studs, joists and/or rafters, wood saws, nail guns, air compressor, sawhorses and other tools. One of the two men doing the work would need fairly comprehensive knowledge of construction and carpentry, and the other would need at least the average carpentry skills of a carpenter's helper to complete the task properly, all of which increases the cost or overhead for the construction or remodeling.

The present invention overcomes this problem by providing a shaped and sized attachment or device for straightening or squaring existing support members, such as studs, joists and/or rafters, each of which respective attachment are adjustable to enable a plurality of such support members to be easily aligned to provide the desired straight and level planar mounting surface for receiving and for affixing the desired exterior finishing member thereon.

The present invention with one relatively simple attachment or device having spaced slots for operative association with adjustable fastening members will enable a user to align and plum a multiplicity of studs, joists or rafters by overcoming nearly all potential problems which may arise from warped, bowed, twisted incorrectly affixed or misaligned studs, joists or rafters found in walls, floors and ceilings in the framing of buildings.

The attachment or devices can be stacked for a given order by the manufacturer, packed and shipped in relatively tight bundles. Conversely, the user of such attachments or devices can purchase, easily transport the purchased quantity of such attachments and devices and can install the same with a minimum of effort using conventional tools and a semi-skilled workman because the spaced slots and the adjustable fastening means allow a given attachment or unit to be adjusted numerous times before it is fixedly connected in the final adjusted position.

Other advantages of the attachment and devices in accordance with the present invention are they can be fastened on either side of the stud, joist or rafter and still be oriented to allow one section thereof to cover the face or front of the stud, joist or rafter which must lie in the plane for establishing the common planar mounting surface. This becomes necessary in the case or archways, corners and blind spots which interfere with hammering the fasteners into position. Further, the attachments or devices are adapted to plum window and door spaces formed in the framing by turning the attachment or devices as a function of the assembly and location and further in the case of window or door openings, the attachments can be used to square and plum such openings or spaces as is more fully described hereafter.

SUMMARY OF THE INVENTION

Thus, the present invention covers attachments and devices for straightening and squaring support members, such as studs, joists or rafters having a sized and shaped member with at least a first section or leg having a flat outer surface and a second section or leg having a flat inner surface connected normal to said first section or leg, sized openings formed in spaced relation to each other on said second section or leg, means for connecting the sized and shaped member in operative position on at least one support member, and means on said connecting means for adjustable movement so the sized and shaped member can be adjustably affixed to a support member to provide at least one flat and level outer face thereon and to enable a plurality of the support members to be easily aligned to form an application plane for affixing any desired exterior finishing members thereon.

It is another aspect of the present invention to provide an attachment or device for straightening and aligning support members such as studs, joists or rafters in a building being constructed or being remodeled which is made of materials that can be pierced by conventional fastening members or cut and then manipulated by conventional carpentry tools.

It is another aspect of the present invention to provide an attachment or device for straightening and aligning support members such as studs, joists or rafters in buildings being constructed or being remodeled which provides a simple attaching device with an adjustable nail for initially and loosely fastening and holding the attachment or device to the support member so measurements or eyeball determinations can be made to adjust the respective attachments or devices on adjacent studs, joists and rafters to establish a common plane, and thereafter each attachment or device can be firmly secured in its adjusted position to provide the planar mounting or affixation surface for exterior finishing materials.

It is another aspect of the present invention to provide an attachment or device complying with the construction industry standards which is sized as a function of the length of pre-existing support members such as wooden studs, joists and rafters for walls, floors and ceilings in buildings under construction or being remodeled which are shaped and have connecting means to be adjustably fitted over such support members so as to straighten or provide at least one flat face on such support members to facilitate the formation of a common plane on a plurality of such support members and provide a planar mounting or application surface to which exterior finishing members can be affixed.

It is still another aspect of the present invention to provide an attachment or device for support members such as studs, joists or rafters in buildings being constructed or being remodeled that can be initially loosely secured to a support member and, after appropriate measurements are made, adjusted and then firmly secured in assembled position so that a plurality of support members can be aligned to provide a substantially common plane along the plurality of support members to establish the straight and level application surface needed for affixing the desired exterior finishing members thereto.

It is another aspect of the present invention to provide a relatively simple method for establishing on existing support members, such as the wooden studs, joists and rafters in buildings, a straight and level application surface for the walls, floors and ceilings in a building which replaces the prior art labor-intensive methods for preparing framed interior sections of buildings to provide the straight and level application surfaces for affixing exterior finishing members thereto.

BRIEF DESCRIPTION OF THE DRAWINGS

The above objects and purposes and the description of the prevent invention as set forth hereinafter will be better understood with reference to the accompanying drawings, in which.

DETAILED DESCRIPTION

Figure 1:
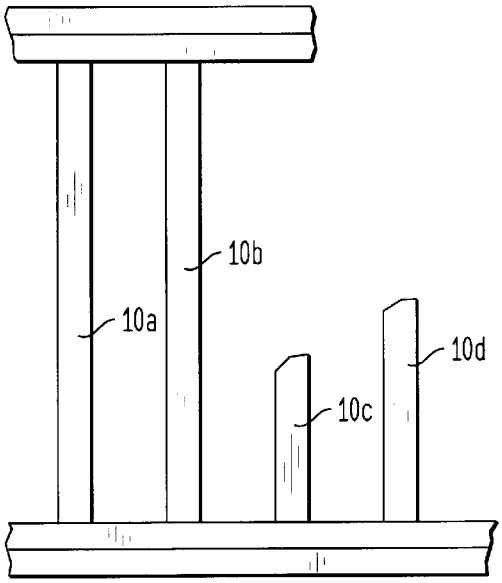
FIG. 1 is a front view of a portion of the framed wall of a room or space in a building being constructed or remodeled showing a plurality of vertical support members or studs.

Referring to the drawings, FIG. 1 shows a few of a plurality of vertical support members such as studs generally designated 10*a*, 10*b*, 10*c* and 10*d* in the framed wall for a room or other space in a building under construction or being remolded. These generally wooden vertical supports or studs need to be aligned with each other in a common plane to form a level planar mounting or application surface for affixing the desired exterior finishing members selected for the given room or space.

Exterior finishing members, when used herein, is intended to mean any type of exterior covering for closing the framed vertical or the like support members such as studs, joists or rafters in a building and for finishing the wall, ceiling or floor formed when the vertical or other supports are so covered. Such exterior finishing members may be wood or wood veneer paneling, sheetrock, wallboard, floor, wall, ceiling tiles, and wooden floor tiles or strips and the like members.

Those skilled in the art will also recognize that the present description, and drawings showing a portion of the framed vertical supports or studs for a room or space in a building, is merely for purposes of illustrating the present invention. The invention therefore is intended to be equally applicable for joists in the floors or rafters in the ceilings of such buildings, and the illustrations are not intended to limit the scope or protection of the present invention.

The present invention provides a simple and cheap device which is relatively easy, to affix to the respective framed vertical supports or studs and to adjust for achieving the desired straightening or squaring where applicable such as a window or door openings or space in the framing and aligning of such vertical supports or studs as shown in FIGS. 2, 3, 4, 5, 21 and 23 of the drawings.

Figure 2:
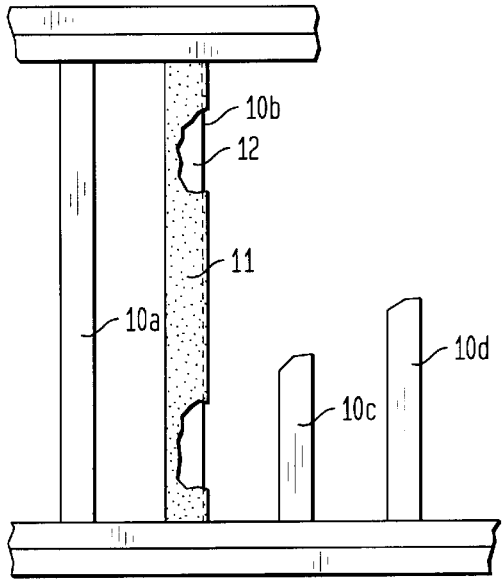
FIG. 2 is the same front view shown in FIG. 1 in which one of the vertical support members or studs has an L-shaped attachment or device for straightening and aligning support members in accordance with the present invention loosely affixed thereto.

Thus, at FIG. 2, a single one of the vertical supports or studs 10*b* has one embodiment of the attachment or device 11 for straightening and aligning a stud, joist or rafter in accordance with the present invention affixed to the side 12 of the vertical support 10*b* whose front end faces the interior of the room or space where the exterior finishing member will be applied.

In the embodiment shown in FIGS. 1 to 9 of the drawing, attachment or device 11 is a sized and shaped member having any desired length up to the length of the vertical support member or stud 10*b* to which it will be affixed. The shaped and sized attachment or device 11 may be made of any suitable materials such as aluminum, steel alloy, tin or reinforced synthetic materials such as plastics and therefore can be fabricated in any of the conventional machines for the mass production of such elongated devices. It will have a limited thickness of about 25 gauge. However, depending on the particular application or use the attachment or device 11 can have a thickness in a range from 15 gauge to 30 gauge without departing from the scope of the present invention. In many instances the thinner gauges will enable the attachment to be pierced or cut by conventional fastening devices and tools used by the carpenters straightening, squaring and aligning the support members such as studs and joists or window and door openings. The thickness of the attachment or device in accordance with the present invention will be such as to maintain the integrity of the attachment or device during use.

Thus, in this embodiment, the sized and shaped member defining and forming the attachment or device 11 is generally L-shaped in cross-section and has a first section or leg 13, a second section or leg 14 which is operatively connected through a half-round connecting section 15 generally normal or at right angles to the plane of the first section or leg 13 to provide the L-shape for the attachment or device 11. The exterior flat outer face of the first section or leg 13 is provided with a plurality of randomly dispersed dimples 16 to aid in fastening the exterior finishing member to the application surface formed when the plurality of studs with the attachments or devices fixed thereon are aligned as is hereinafter described. At the end of the section or leg 14 remote from the end connected to the first section or leg 13, the material from which the support member of the attachment or device 11 is made is folded on itself and tightly flattened as at 17. The half-round connecting section 15 and the folded end 17 of the second section or leg 14 serve to strengthen the attachment or device 11 to make them easier to handle, prevent unused lengths from being damaged and thus extend the useful life of these attachments or devices, all of which is shown in FIGS. 3, 4, 5 and 6 of the drawings.

Figure 8:
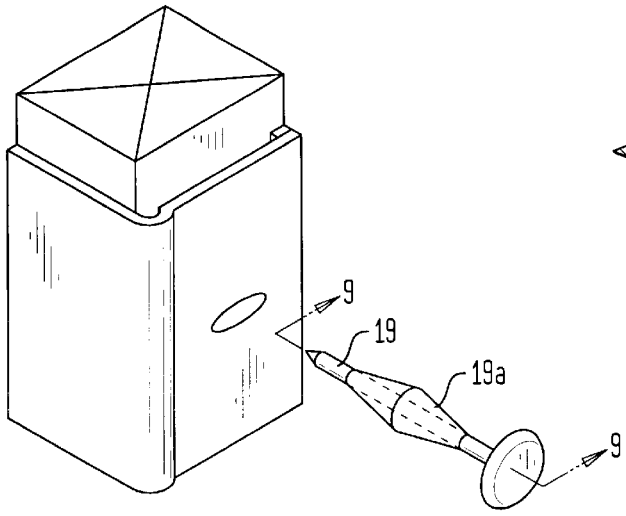
FIG. 8 is a fragmentary section showing an enlarged view of the fastening means for adjustably connecting the L-shaped attachment or device shown in FIGS. 2 and 3 to the associated stud.
Figure 9:
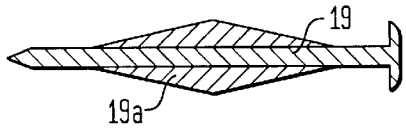
FIG. 9 is a cross-section taken on line 9—9 of FIG. 8 through the connecting means.
Figure 3:
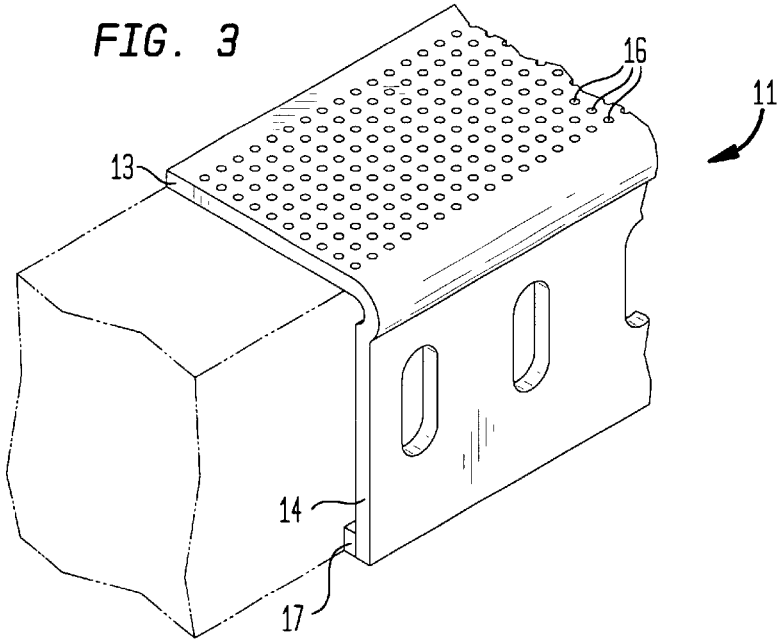
FIG. 3 is a longitudinally extending perspective view of a portion of the L-shaped attachment or device for straightening and aligning support members in accordance with the present invention, as shown in FIG. 2 of the drawings, showing the support member or stud in dashed lines.
Figure 4:
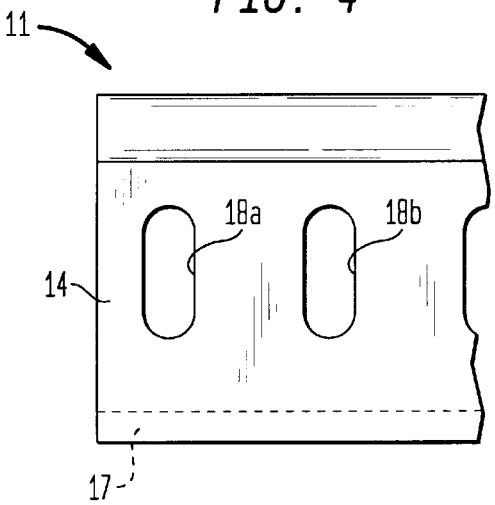
FIG. 4 is a top plan view of a fragment of the L-shaped attachment or device shown in FIGS. 2 and 3 of the drawings.
Figure 5:
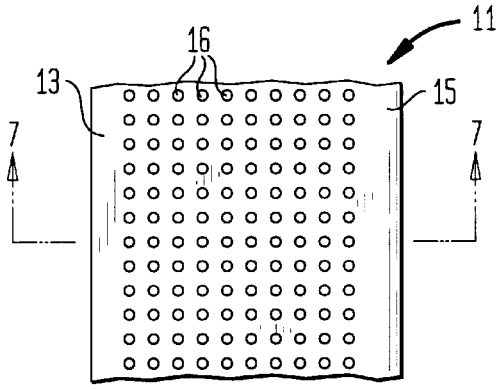
FIG. 5 is a bottom plan view of a fragment of the L-shaped attachment or device shown in FIGS. 2 and 3 of the drawings.
Figure 6:
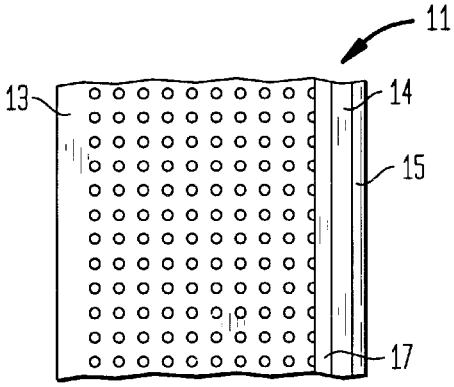
FIG. 6 is a side elevational view of a fragment of the L-shaped attachment or device shown in FIGS. 2 and 3 of the drawings, showing the plurality of spaced elongated openings in the second section or leg of the attachment or device.
Figure 7:
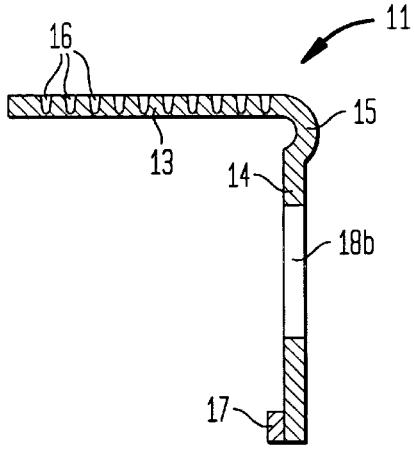
FIG. 7 is a cross-section taken on line 6—6 of FIG. 4.
Figure 10:
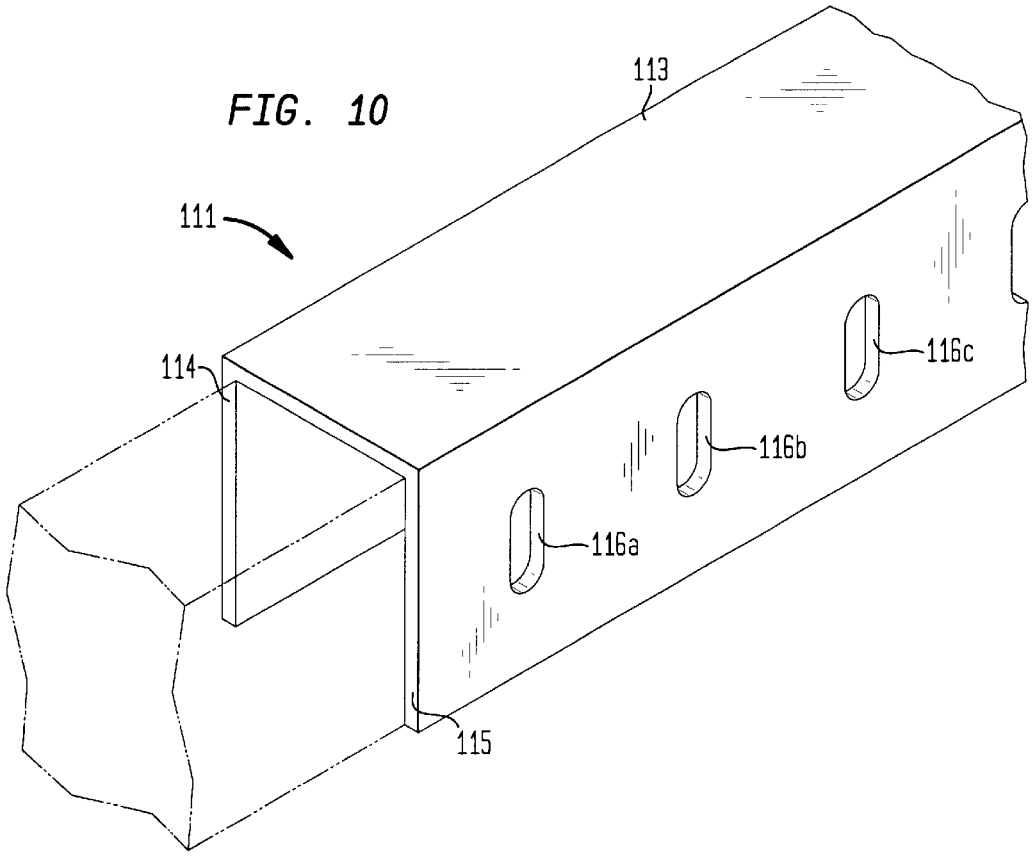
FIG. 10 is a longitudinally extending perspective view of a portion of a U-shaped attachment or device for straightening and aligning support members in accordance with the present invention mounted on a support member or joist, shown in dashed lines and having a connecting means shown in an exploded position relative one o the spaced openings.
Figure 11:
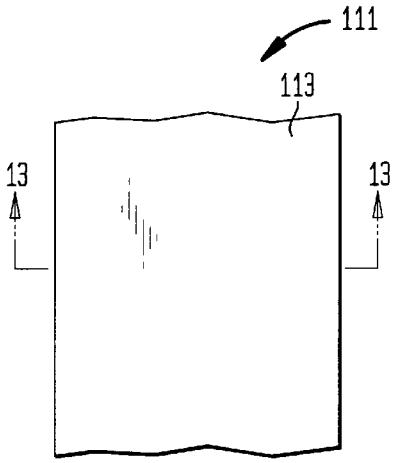
FIG. 11 is a fragmentary top plan view of the U-shaped attachment or device shown in FIG. 8 of the drawings.
Figure 12:
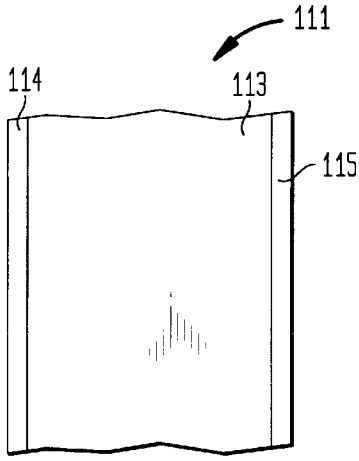
FIG. 12 is a fragmentary bottom plan view of the U-shaped attachment or device shown in FIG. 8 of the drawings.
Figure 13:
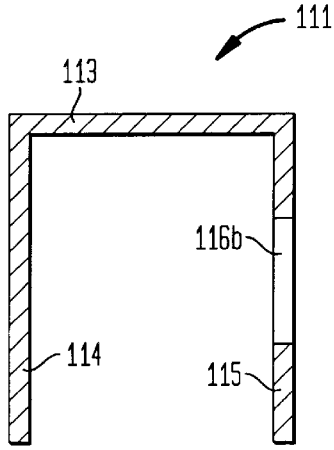
FIG. 13 is a cross-section taken on line 13—13 of FIG. 11.
Figure 14:
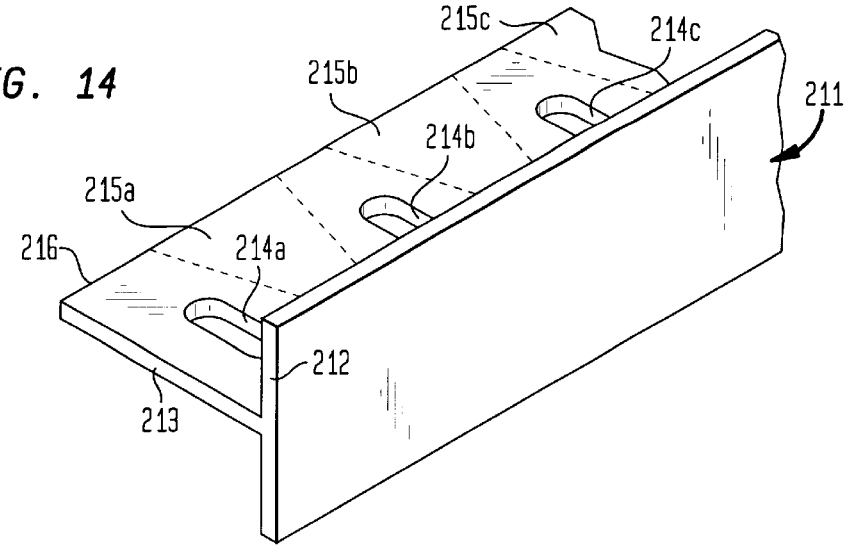
FIG. 14 is a longitudinally extending perspective view of a portion of T-shaped attachment or device for straightening and aligning support members in accordance with the present invention for use where the support member is curved or arcuate.
Figure 15:
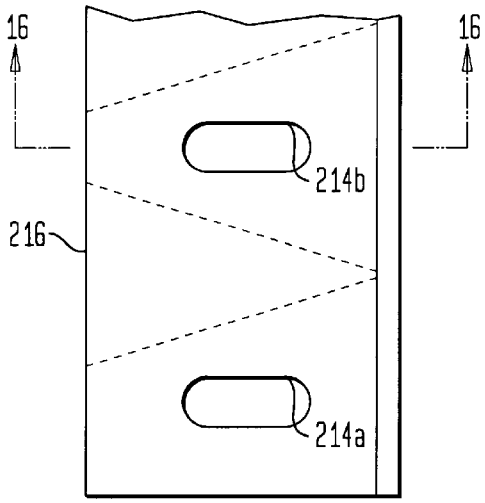
FIG. 15 is a fragmentary top plan view of the T-shaped attachment or device for straightening and aligning support members as shown in FIG. 12 of the drawings.
Figure 17:
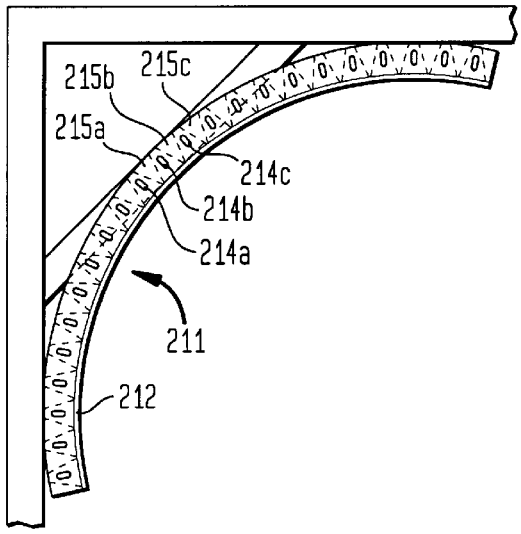
FIG. 17 shows the T-shaped attachment or device for straightening and aligning curved support members shown in FIGS. 14, 15 and 16 in assembled position on a corner section of the wall in a room of a building being constructed or remodeled.
Figure 16:
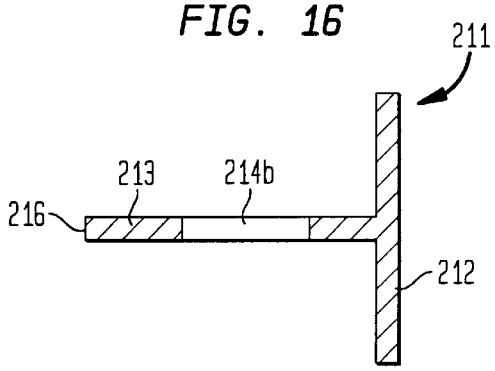
FIG. 16 is a cross-section taken on line 16—16 of FIG. 15.

In order to establish the operative interrelation of the L-shaped attachment or device 11 for straightening and aligning the vertical support member or stud 10*b*, it is necessary to first loosely affix the attachment or device 11 to the vertical support or stud 10*b* by fastening means which allow for further adjustment of the attachment or device 11 relative other such devices, not shown, on the adjacent plurality of support members for the wall, to obtain the common plane for forming the planar mounting or application surface for affixing the exterior finishing members to the plurality of vertical support members or studs to provide the desired finishing of the given room or space. This is accomplished by means of a plurality of openings as at 18*a* and 18*b* formed in the second section or leg 14 of the support member forming the remedial attachment or straightening and aligning device 11. These openings are formed at predetermined spaced intervals along the length of the support member and are sized smaller than the fastening members such as the nylon sheathed nails 19; i.e., standard roofing nails with tapered nylon bushings 19*a* on the medial section thereof as is shown in FIGS. 8 and 9 of the drawings. The nylon sheathed nails 19 are inserted through at least one or more of the openings 18*a* and 18*b* to enable the L-shaped attachment or device 11 to be loosely attached and initially held onto the vertical support member or stud 10*b* and then adjusted for establishing the common plane to provide the affixation surface for a plurality of studs or joist for the exterior finishing surface as is more fully described hereinafter. While nails with nylon bushings are shown and described above, those skilled in the art will recognize that other types of fastening devices can be used for this purpose without departing from the scope of the present invention.

Nails having a nylon bushing on the outside surface thereof are purchasable on the open market and include conventional sized standard roofing nails that have been fitted with the a nylon bushing which taper from their center to the respective opposite ends. The nylon bushings have a diameter at their widest point of about 7/32" and taper down to the ends to about 5/32". The spaced slots or openings 18*a* and 18*b* have an inner diameter of about 3/16" so that when the nylon sheathed nail 19 is inserted into one of the slots or openings 18*a* and 18*b*, the nylon bushing in assembled position, will have a friction fit and make the precise adjustment of the L-shaped attachment or device for the associated stud easier to accomplish. The semi-rigid and non-stick character of the nylon bushing makes insertion of the fastening member or nylon sheathed nail 19 in one of the slots or openings 18*a* and 18*b* less critical, and the nylon bushing 19*a*, while having the initial resistance due to the friction fit to hold the L-shaped attachment or device 11 in place, will also allow the L-shaped attachment or device 11 to slide easily along the nylon sheathed nail 19 to the best and precise adjusted position for establishing the common plane of the planar mounting or application surface. Then without modifying the adjustment position of the L-shaped attachment, the nylon sheathed nail can be hammered into the associated stud to fix the L-shaped attachment or device in its adjustment position.

Further, measurements and alignments are similarly made with other of the attachments or devices 11 in accordance with the present invention, not shown, that are mounted on the plurality of other vertical support members or studs 10*a*, 10*c* and 10*d* until the common plane forming the planar mounting or application surface for affixing the exterior finishing members to such vertical support members or studs is established. Then each of the other attachments or devices 11 can be securely affixed into position.

In use, in order to align a plurality of framed vertical support members or studs for a given wall in order to provide the desired planar mounting or application surface for covering the vertical support members and affixing the exterior finishing members thereto, each or as many of the vertical support members or studs which are warped, bowed, twisted or misaligned first have an L-shaped attachment or straightening and alignment device 11 loosely affixed thereto as above described. Then by any conventional means such as a string line or elongated level, the respective attachments or straightening and aligning devices 11, loosely fastened on the vertical support members or studs, are adjusted until the respective exterior or outer face of the first section or leg 13 of each of the attachments or devices 11 are in a common plane. Then, they are each fixedly connected to their associated vertical support member or stud, in their adjusted position. The respective L-shaped members 11 on the associated vertical support members or studs are now in a common plane and thus provide the desired common planar mounting or application surface for affixing the exterior finishing members thereto to provide the desired finish for the given room or space in the building as may be necessary during the construction or remodeling of the building.

Since the L-shaped attachments or straightening and aligning devices 11 are cheap and easy to affix, a simple, easy and cheaper method is provided for obtaining a straight and level application surface for further affixation of the exterior finishing members.

FIGS. 10, 11, 12 and 13 show a further embodiment of the present invention which differs from the embodiment shown at FIGS. 1 to 9 and described above, in that the attachment or straightening and aligning device 111 shown in FIGS. 10 to 13 is a sized and shaped member which has a U-shape in cross-section. This shape is particularly adapted for use with horizontal support members such as joists and rafters in the floors and ceilings of buildings under construction or being remodeled.

In this embodiment the sized and shaped member defining the attachment or straightening and aligning device 111 has a first transverse section 113 to which a second longitudinally extending section or leg 114 and a third longitudinally extending section or leg 115 spaced from said first section or leg 114 are connected normal or at right angles to the first transverse section 113 to form the U-shaped attachment or straightening and aligning device in accordance with the present invention. If necessary, to provide additional strength to the support member, the transverse section and spaced longitudinally extending legs can be connected together with the same type of half circle connecting section and, in addition, the ends of the spaced second and third legs 114 and 115 can be turned on themselves, as above described for the form of the L-shaped attachment or straightening and aligning device 11 shown at FIGS. 3, 4, 5, 6 and 7 of the drawings.

As in the earlier embodiment, at least one of the spaced legs such as third section or leg 115 is provided with a plurality of spaced elongated and sized openings as at 116*a*, 116*b* and 116*c* so that the U-shaped attachment or straightening and aligning device 111 can be initially attached and held to a floor, joist or ceiling rafter with a fastening member such as the nylon sheathed nail inserted into one or more of the openings 116*a*, 116*b* and 116*c* as above described. Thereafter, when a plurality of such attachments and the joists or rafters to which they are connected are suitably measured and adjusted, establish the common plane for providing the application surface for affixing the exterior finishing members to their respective associated joists or rafters.

The use of the U-shaped attachment or straightening and aligning device 111 is identical to that as above described for the form of the invention shown in FIGS. 3, 4, 5, 6 and 7 of the drawings.

Where there are curved or arcuate support members or arches in the framing of a wall for a room or space in a building under construction or being remodeled, the attachment or straightening and aligning device must be modified to permit the carpenter or installer to bend the attachment or device so that it can be fitted onto such curved or arched support.

The embodiment to achieve this end is shown at FIGS. 14, 15, 16 and 17 of the drawings where the attachment or straightening and aligning device 211 is a generally T-shaped shaped and sized member having a vertical section 212 and a horizontal section 213 connected normal or at generally right angles thereto. The horizontal section as in the earlier embodiments is provided with a plurality of elongated and spaced openings as at 214*a*, 214*b* and 214*c*. The attachment or device 211 may be made of a material such as tin or galvanized sheet steel so that conventional tin snipping shears can be used to cut slits, generally V-shaped cutouts or the like indentations as at 215*a*, 215*b* and 215*c* into the outer edge 216 of the horizontal section 213 as shown by the dotted lines in FIGS. 12 and 15 of the drawings. When these V-shaped cutouts are made in the T-shaped attachment or device 211, those skilled in the art will recognize that it can then be bent to fit curved or arched support members for a wall, ceiling or floor in a given room being constructed or remodeled.

Thus, in use, the attachment or device 211 is cut to provide the necessary V-shaped cutouts needed to bend the T-shaped attachment or device 211 to fit curved or arcuate support members. Then the attachment or device 211 is loosely affixed to the support member by nailing it in position with a nylon sheathed fastening member 19 as above described. After all measurements and aligning steps are taken and the T-shaped attachment or device 211 is properly positioned for establishing the common planar mounting or application surface, it is then securely fastened into assembled position.

In some instances studs, joists or rafters are so warped, bowed or twisted that it is difficult to affix the L-shaped attachment or device 11 or impossible to affix the u-shaped attachment or device 111 on such given studs or joists. In order to provide a properly spaced means for affixing the exterior finishing members, the attachment or device in accordance with the present invention can be mounted in juxtaposition so as to substantially substitute for such warped bowed or twisted stud or joist.

Figure 18:
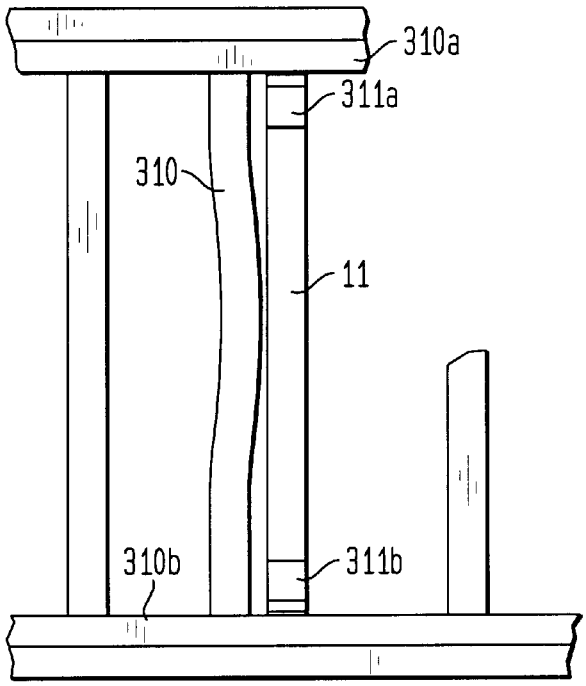
FIG. 18 is a front view of a further embodiment showing the use of an attachment or device in accordance with the present invention being placed adjacent and as a substitute for a warped and twisted stud in a framed wall.
Figure 19:
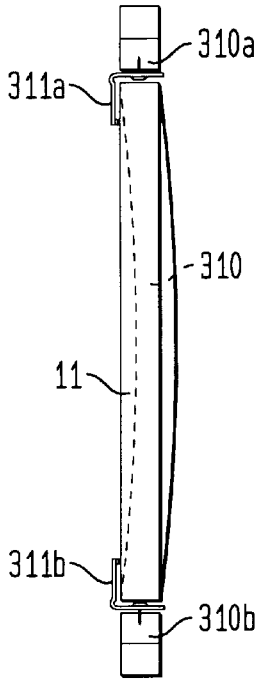
FIG. 19 is a side view of the substitute attachment or device shown in FIG. 18 in assembled position.
Figure 20:
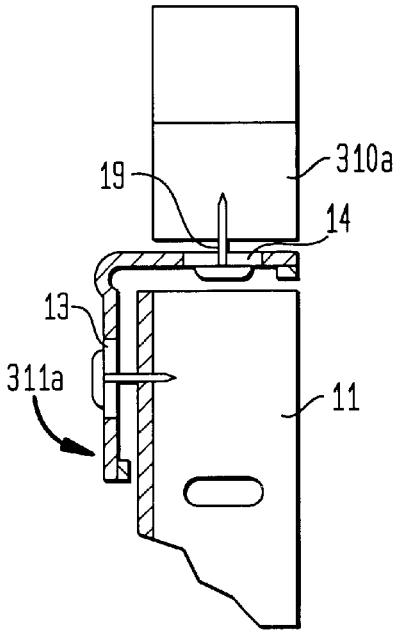
FIG. 20 is a side view partly in cross-section showing the short length or cleat and one operative end of the attachment or device shown in FIGS. 18 and 19 for mounting the attachment or device into assembled position.

Thus, in the embodiment at FIGS. 18, 19 and 20, a warped and twisted stud 310 which requires replacing is shown connected by conventional nailing between an upper header 310*a* and a lower header 310*b*. Using the upper plate 310*a* and the lower plate 310*b*, the L-shaped attachment 11 can be affixed in position adjacent to the warped and twisted stud 310. This is accomplished by cutting two relatively short lengths or cleats 311*a* and 311*b* of approximately 4', off of an extra L-shaped attachment or device 11 and initially loosely affixing one length 311*a* to the upper header 310*a* and the other length 311*b* to the lower plate 310*b*. The short lengths or cleats 311*a* and 311*b* are so affixed that the respective second section or leg 14 with the opening therein for length 311*a* is loosely connected to the lower face of the upper header 310*a* and the length 311*b* is loosely connected to the upper face of the lower plate 310*b*. Thus, when the respective second sections or legs 14 on the lengths 311*a* and 311*b* are adjusted and fixedly connected in position, the respective outer faces of the first sections or legs 13 on each of the short lengths or cleats 311*a* and 311*b* will lie in the common plane of the attaching surface for the exterior finishing member. When the short lengths or cleats 311*a* and 311*b* are loosely fixed in adjusted position, then a suitable length of the L-shaped attachment or device 11 equivalent to the distance between the upper plate 310*a* and the lower plate 310*b* is fitted into position adjacent to the warp and twisted stud 310 and a fastening member such as the nylon sheathed nail 19 is used through one of the openings to loosely fasten the L-shaped attachment or device 11 to the stud 310. After, all adjustments are made to bring the front face of section or leg 13 of the L-shaped attachment or device 11 into alignment with the common plane of the other attachment or devices on the remaining plurality of studs or joists the fastening members are all set into their fixed positions.

In a still further embodiment the present invention utilizes the L-shaped or U-shaped attachments or devices for squaring framed windows and doors openings and spaces or skylight opening or spaces and aligning the studs, joists or rafters around these openings or spaces in the framed building so they will also lie in the common plane of the planar mounting or application surface for the exterior finishing members and to enable windows doors or skylights to be fitted into assembled position in the given opening or space.

Thus, referring to FIGS. 21, 22, 23 and 24, this is illustrated with respect to a section of framing in a building around a window opening or space 400. The framing includes, spaced vertical studs as at 401 and 402 and spaced upper and lower headers as at 403 and 404 connected between the vertical studs to define the enclosed space 400. While the studs and headers are shown as single members, it is well known in the building art that such spaces often have double studs and double headers to increase the strength of the framing to support the windows and doors which are hung and mounded in such spaces.

It is first desirable to square the window opening or space 400 before bringing the attachment end or side of the respective studs 401 and 402 and the upper and lower headers 403 and 404, framing the window opening or space 400 into alignment with the common plane for the planar mounting or application surface for the exterior finishing members which is established for the plurality of other studs in the associated framing in which the window opening or space 400 is positioned.

Figure 21:
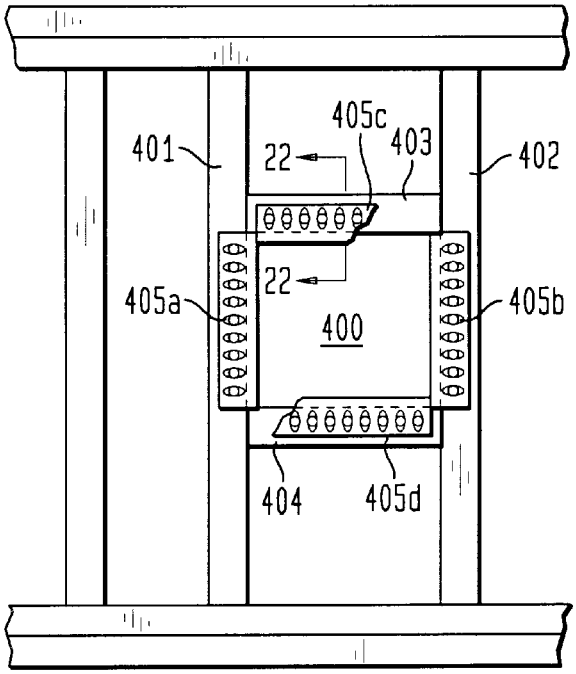
FIG. 21 is a front view of the framing about a window opening or space formed in a framed wall using attachments and devices in accordance with the present invention thereon for squaring-up the window opening or space.
Figure 22:
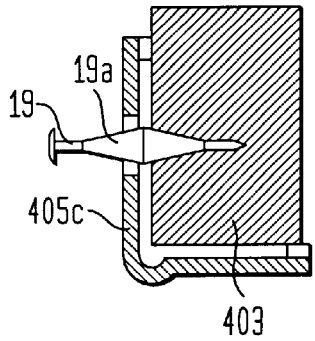
FIG. 22 is a cross-section taken on line 22—22 of FIG. 21.

FIGS. 21 and 22 illustrate one embodiment for squaring up the window opening or space 400 by using sized lengths of the L-shaped attachment or device 11. Thus, in FIGS. 21 and 22 lengths of the L-shaped attachment or device 11 are cut to fit and are affixed to the inside dimensions of the vertical studs 401 and 402 and the upper and lower headers 403 and 404 defined by the window or opening space 400. Thus, cut length of the L-shaped attachment 405*a* is affixed to vertical stud 401, cut length of the L-shaped attachment 405*c* is affixed to the vertical stud 402, cut length of the L-shaped attachment 405*b* is affixed to the upper header 403 and cut length of the L-shaped Attachment 405*d* is affixed to the lower header 404.

These cut lengths of the L-shaped Attachment 405*a*, 405*b*, 405*c* and 405*d*, in the same manner as above described, are first loosely connected into assembled position with nylon sheathed nails 19 and then after the window opening has been properly squared these adjusted cut lengths of the L-shaped Attachment are fixedly connected to their associated studs and headers, as is shown in FIGS. 21 and 22.

It is now still necessary to adjust the front, or attachment faces of the vertical studs 401 and 402 and the upper and lower header 403 and 404 for the window opening or space 400 so that they are in the common plane of the planar mounting or application surface for the exterior finish members formed for the plurality of studs framing the wall in which the window space or opening is formed.

Figure 23:
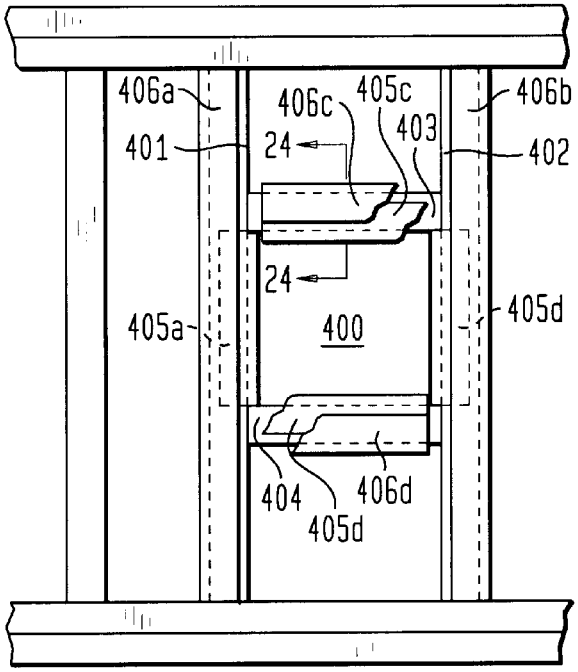
FIG. 23 is the same front view of the framing about a window opening or space using the attachments or devices for securing the window opening or space as shown in FIG. 21 with further attachments and devices in accordance with the present invention added for plumbing and aligning the exterior face of the framing members about the window opening or space with the common plane for establishing the planar mounting or application surface for the exterior finishing members.
Figure 24:
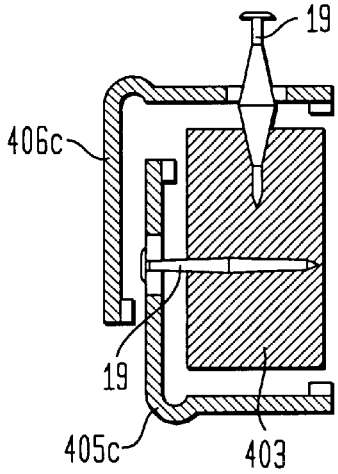
FIG. 24 is a cross-section taken on line 24—24 of FIG. 23.

FIG. 23 and 24 illustrate one embodiment for adjusting the inner or room faces of these same vertical studs 401 and 402 studs and upper and lower headers 403 and 404 using an L-shaped Attachment or device in accordance with the invention as at 406*a* on vertical stud 401, 401*b* on vertical stud 402, and 406*c* on upper header 403 and 406*d* on lower header 404. Each of these L-shaped attachments or devices 506*a*, 506*b*, 506*c* and 506*d* are first loosely connected to the associated studs 401 and 402 and the associated headers 403 and 404 by a fastening member such as the nylon sheathed nail 19 in the same manner as above described for the form of the invention shown in FIGS. 1 to 9 of the drawings using at least one of the elongated slots in the second section or leg 13, the cut lengths of the L-shaped attachment being position so they contact with and cover the cut lengths of the L-shaped attachment 405*a*, 405*b*, 405*c* and 405*d* used to square up the window opening or space 400, as is shown in FIGS. 23 and 24 of the drawings. Then, after the L-shaped attachment such as 406*a* and each of the respective other attachments 406*b*, 406*c* and 406*d* are adjusted so that their front or room face is plumb with the common plane for the planar mounting or application surface for the exterior finishing members, these L-shaped attachments or devices are fixed in assembled position.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. In combination, attachments for straightening existing studs, joists and rafter support members with a plurality of such existing support members wherein each of said attachments comprises:

a. a sized member having a predetermined shape with a first leg defining a flat outer surface, and a second leg having a flat inner surface connected to said first leg and disposed generally normal to said first leg, b. sized openings in said second leg spaced from each other at predetermined intervals to enable said sized member to be adjustably fixed to an associated one of the plurality of support members, and c. each sized member on each respective one of the plurality of studs and joists adjustably disposed to align the outer surface on each respective first leg thereof to establish a planar application surface for the plurality of support members.

2. In the combination as in claim 1 including exterior finishing members affixed to said planar application surface formed by the attachments to the plurality of support members.

3. In the combination as in claim 1 including fastening means each having a slidable means thereon operatively associated with at least one of the sized openings for enabling a respective attachment to be adjustably affixed to an associated one of the plurality of support members.

4. In the combinations as in claims 1 or 2 including:

a. fastening means each having a slidable member thereon operatively associated with at least one of the sized openings for enabling a respective attachment to be adjustably affixed to an associated one of the plurality of support members, and b. each of the openings in said second leg sized to provide sufficient frictional engagement with the fastening means to initially hold the respective one of the attachments to the associate one of the plurality of support members and then to enable the attachment to be securely affixed thereto.

5. In the combinations as in claims 1 or 2 including:

a. fastening means for affixing the respective attachments to their associated one of the plurality of support members, and b. each of the openings in said first leg sized to provide sufficient frictional engagement with the fastening means to initially hold the attachment to the associated one of the plurality of support members.

6. The combinations as claimed in claims 1, 2 or 3 wherein the sized member has means thereon to strengthen the sized member.

7. The combinations as claimed in claims 1, 2 or 3 wherein the shaped openings on the sized member are generally elongated.

8. The combinations as claimed in claims 1, 2 or 3 wherein the sized member of the respective attachments is L-shaped.

9. The combinations as claimed in claims 1, 2 or 3 wherein the sized member of the respective attachments is U-shaped.

10. The combinations as claimed in claims 1, 2 or 3 wherein the sized member of the respective attachments is T-shaped.

11. The method of forming a planar application surface with a plurality of existing studs, joists and rafter support members in the framing for a building for affixing exterior finishing members thereto, the steps of:

a. loosely connecting an attachment having at least one leg with a flat outer surface to at least one face of an associate one of the plurality of support members, b. adjusting each attachment so that the flat outer surface of the first leg on each such attachment is in alignment with the first leg of each other attachment, and c. securely fixing the adjusted position of each respective attachment on their respective associated one of the plurality of support members to form the planar application surface for receiving the exterior finishing members.

* * * * *

UNITED STATES PATENT AND TRADEMARK OFFICE

CERTIFICATE OF CORRECTION

PATENT NO. : 6,523,315 B2
DATED : February 25, 2003
INVENTOR(S) : Dan Ford

It is certified that error appears in the above-identified patent and that said Letters Patent is hereby corrected as shown below:

Column 12,
Lines 33, 37, 42 and 54, “In the” should read -- The --.
Lines 33, 37, 42 and 54, after “as” insert -- claimed --.

Signed and Sealed this

Twelfth Day of August, 2003

JAMES E. ROGAN
*Director of the United States Patent and Trademark Office*